United States Patent [19]

Jackman et al.

[11] Patent Number: 4,791,776

[45] Date of Patent: Dec. 20, 1988

[54] METHOD AND APPARATUS FOR FILLING A BAG WITH INDIVIDUAL PACKS OF ARTICLES OR PRODUCE

[75] Inventors: Raymond W. Jackman; Anthony C. Monk, both of Braintree, Great Britain

[73] Assignee: W. J. Morray Engineering Limited, Braintree, United Kingdom

[21] Appl. No.: 89,416

[22] Filed: Aug. 25, 1987

[30] Foreign Application Priority Data

Sep. 3, 1986 [GB] United Kingdom ..... 8621259

[51] Int. Cl.[4] ..... B65B 5/00

[52] U.S. Cl. ..... 53/570; 53/248; 53/469; 141/10; 141/114; 141/317

[58] Field of Search ..... 53/469, 551, 570, 451, 53/248, 501, 249; 114/10, 114, 317

[56] References Cited

U.S. PATENT DOCUMENTS

| | | | |
|---|---|---|---|
| 2,647,670 | 8/1953 | Cox | 53/248 X |
| 2,925,162 | 2/1960 | De Tuncq | 53/248 X |
| 3,256,673 | 6/1966 | Tew | 53/551 |
| 4,074,507 | 2/1981 | Ruf | 141/114 X |
| 4,532,753 | 8/1985 | Kovacs | 53/551 X |
| 4,570,419 | 2/1986 | Tinsley | 53/248 X |
| 4,932,186 | 2/1984 | McGregor | 141/114 X |

FOREIGN PATENT DOCUMENTS

| | | | |
|---|---|---|---|
| 2451334 | 11/1980 | France | 141/114 |

*Primary Examiner*—John Sipos

*Attorney, Agent, or Firm*—Browdy and Neimark

[57] ABSTRACT

A method and apparatus for filling a bag with packs of produce or articles, in which the bag is suspended from a bag clamp and flattened by pairs of opposing lowering plates at spaced intervals down the bag. The packs are assembled in a batch of two or more packs on a platform formed by hinged plates which are swung downwards to deposit each batch in turn in the bag. The packs are supported initially on the wall of the bag covering the uppermost lowering plates, and the pairs of lowering plates are swung downwards in sequence to allow the packs to drop in stages within the bag. The filled bag is released from the bag clamp onto a conveyor which transports the filled bag to a closure device. The wall of the filled bag is supported by a suction head during movement along the conveyor to the closure device.

5 Claims, 4 Drawing Sheets

METHOD AND APPARATUS FOR FILLING A BAG WITH INDIVIDUAL PACKS OF ARTICLES OR PRODUCE

This invention relates to the filling of a bag, sack or other collapsible container with individual packs of articles or produce.

In the filling of a large bag with individual packs of articles or produce, the packs occupying the bottom portion of the bag are liable to break open and/or their contents be damaged due to the long drop of the packs from the top to the bottom of the bag. In particular, vegetable produce wrapped in packs can easily be damaged by impact between the packs.

The object of the invention is to provide an improved method and machine for filling a bag with preformed packs which prevents or reduces substantially the risk of damage to the packs or their contents.

According to one aspect of the present invention there is provided a method of filling a bag or sack with individual packs of produce or articles, comprising supporting the bag in an upright position with the mouth thereof open at the top of the bag, at least partially flattening a portion of the bag below the mouth therof to form a constriction of the interior of the bag, feeding the packs into the mouth of the bag so that the packs are supported initially on the walls of the bag at the constriction, releasing the constriction to permit the packs to drop into the lower portion of the bag, and continuing to feed the packs into the bag to fill the bag.

In the method of the invention the first packs to be fed into the bag are lowered by stages to the bottom of the bag, thereby preventing or reducing the risk of damage to the packs due to impact with one another.

Preferably, the bag is at least partially flattened at spaced intervals along the length of the bag to form a plurality of constrictions of the interior of the bag, the packs being supported initially on the walls of the bag at the uppermost constriction, and the constrictions being then released in sequence by releasing the constriction which is uppermost to permit the packs to drop in several stages into the lower portion of the bag.

The bag can conveniently be flattened at spaced intervals along the length of the bag by plates or abutments arranged to engage the exterior of the bag at opposite sides thereof, the plates being movable or pivotable towards and away from one another by mechanical, hydraulic or pneumatic mechanisms. Alternatively, the bag may be flattened by inflatable bladders or counter weighted rollers.

The bag may be made of paper, plastics, net or any other suitable material which enables the bag to be flattened at spaced intervals by pressure applied to the exterior of the bag at opposite sides thereof.

The wall of the bag is preferably clamped between jaws adjacent the mouth of the bag so that the bag is suspended from the jaws during the feeding of the packs into the mouth of the bag. The bag can conveniently be suspended over a conveyor, the jaws being released when the bag is filled to permit the bag to drop onto the conveyor.

In a preferred arrangement according to the invention in which the bag is suspended by jaws over a conveyor, the bag passes through a suction head having surfaces formed with apertures connected to a source of vacuum, the surfaces being in contact with the bag and the vacuum holding the bag against the apertured surfaces and thereby supporting the bag during downward movement of the bag onto the conveyor. The suction head can conveniently be moved along the conveyor at the same speed as the conveyor when the filled bag is deposited on the conveyor, whereby the suction head supports the bag during its movement along the conveyor.

The suction head is suitable for supporting the wall of the bag during feeding of the bag into a heat sealing device, particularly when the wall of the bag is thin, for example two thousandths of an inch.

In the method of the invention, the packs are preferably assembled in small batches by count with the packs in each batch aligned with or parallel to one another or otherwise arranged so as to occupy the minimum volume, and the batch deposited as a complete assembly into the open mouth of the bag. For this purpose, the bags are preferably assembled into a batch on hinged batch plates movable between a horizontal position providing a platform supporting the packs and a vertical dependent position in which the batch plates are spaced apart to permit the batch of packs to drop into the bag. Alternatively the batch may be assembled on a horizontal gate which can be withdrawn to deposit the packs into the bag. The filling of the bag in batches in this way is particularly advantageous with packs of coal or other hard material or articles which tend to become jumbled if fed into the bag at random. Jumbled packs will of course occupy a greater volume within the bag than packs which are neatly arranged in layers.

According to another aspect of the invention there is also provided a machine for filling a bag or sack with individual packs of produce or articles, comprising a main frame fitted with a bag clamp for supporting a bag in an upright position with the mouth thereof open at the top of the bag, a conveyor operable to feed the packs into a bag held in the bag clamp, and constriction means mounted on the frame below the bag clamp and operable to at least partially flatten a portion of the bag to form a constriction of the interior of the bag while the bag is held in the bag clamp whereby packs fed into the bag are supported initially on the walls of the bag at said constriction, the constriction being releasable to permit the packs to drop into the lower portion of the bag.

Mechanism for flattening the bag at spaced intervals along the length of the bag in accordance with the invention is preferably housed in two opposing constrictor units arranged below the bag clamp, one of the constrictor units being fixed and the other constrictor unit being movable between an operating position in which it is in opposing relationship to the fixed constrictor unit so that a bag on the bag clamp is suspended between the constrictor units and an offset position in which the movable constrictor unit is displaced to one side of the fixed constrictor unit. This arrangement has the advantage that, when the movable constrictor unit is in the offset position, the bag clamp is readily accessible for fitting a bag thereon and can conveniently be supplied automatically with a bag at the start of each cycle of operations. In an arrangement having a belt or roller conveyor for removing full bags released from the bag clamp, the movable constrictor unit is preferably movable in directions parallel to the conveyor and at the same speed, and the movable constrictor unit is preferably fitted with a suction head as described above for supporting a filled bag.

The mechanism for feeding the packs into the bag is preferably regulated by control means operable to count the number of packs for each layer and the total number of packs fed into each bag and to stop the supply of packs to the bag when a predetermined number has been fed into the bag. A machine for filling bags or sacks with individual packs of produce or articles will now be described, by way of example, with reference to the accompanying drawings, in which.

Figure 1:
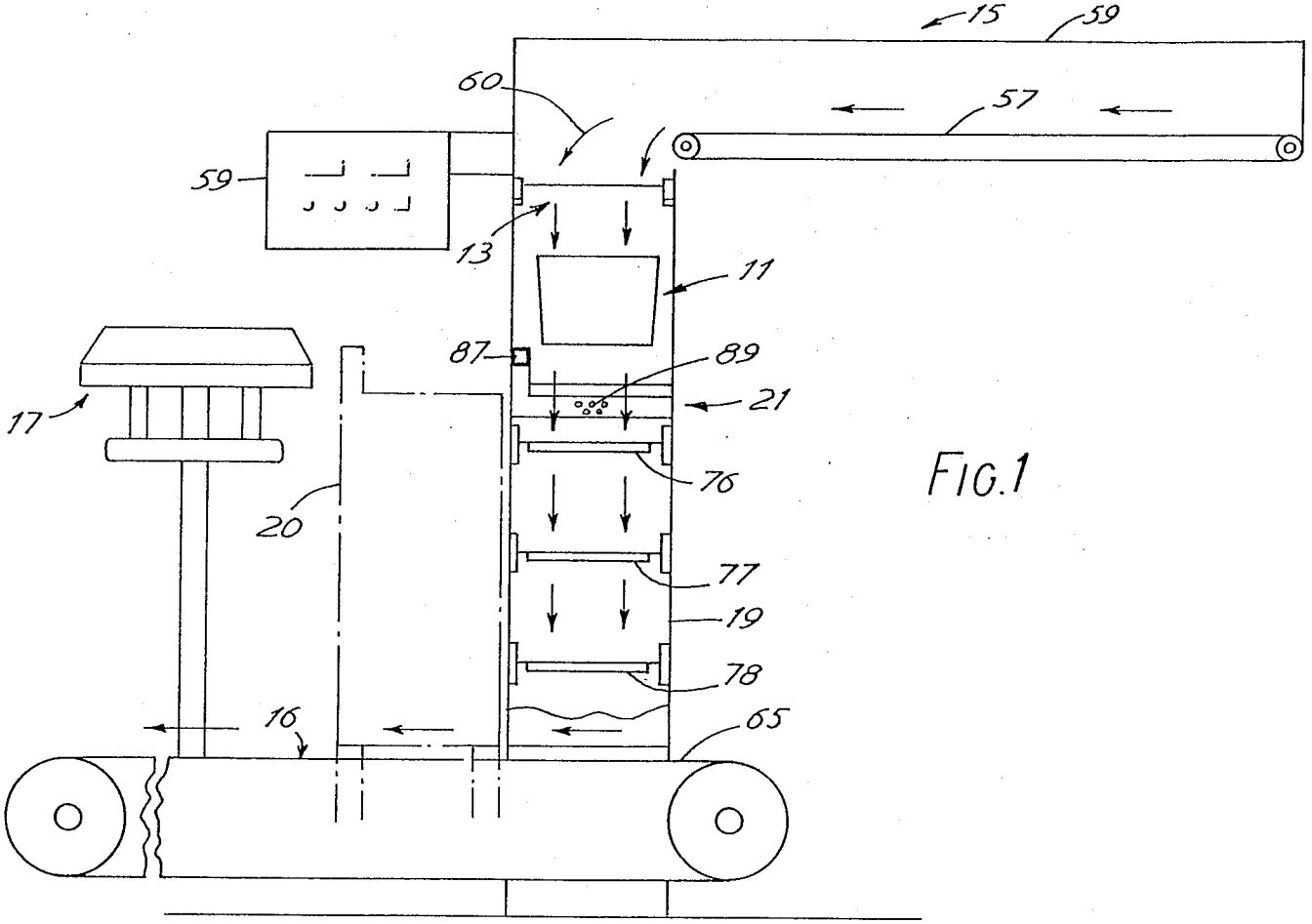
FIG. 1 is a diagrammatic representation of the machine in side elevation illustrating components of the machine and showing the movable constrictor unit in full lines in its rear position and in broken lines in its forward position.
Figure 2:
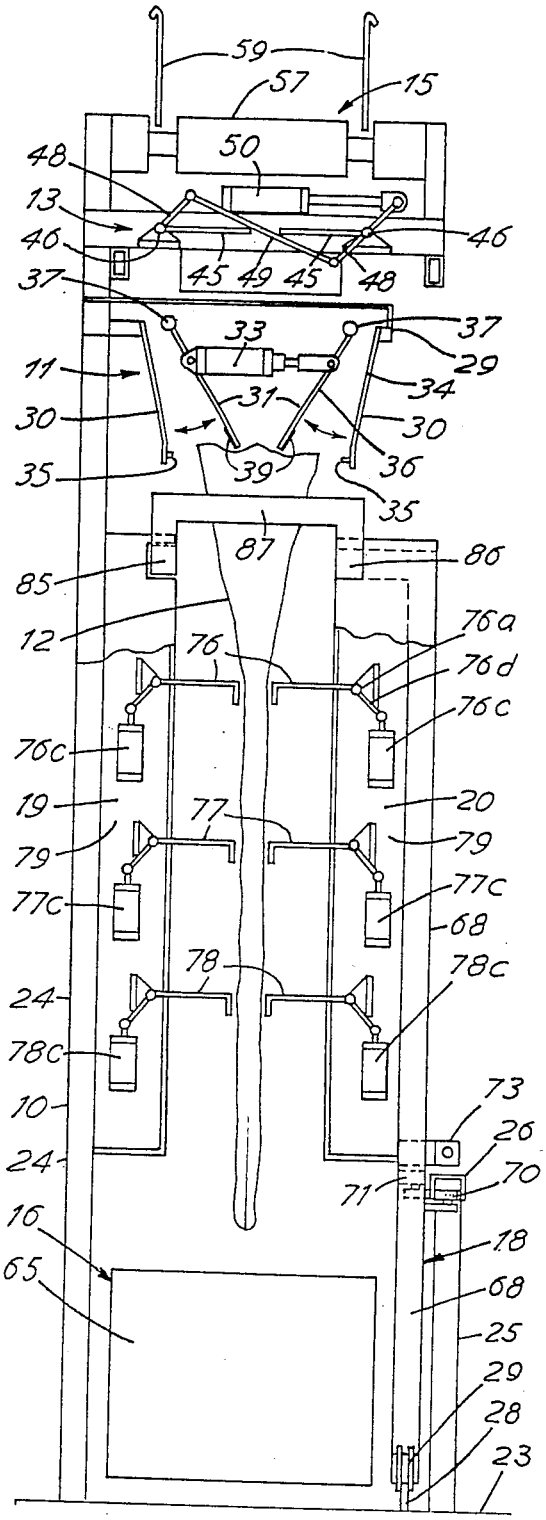
FIG. 2 is a cross sectional view of the machine showing the construction of the components illustrated diagrammatically in FIG. 1.

The machine shown in the drawings comprises a main frame 10 fitted with a bag clamp 11 (FIG. 2) for supporting a bag 12 in an upright position with the mouth thereof open at the top of the bag, a batch feed device 13 mounted on the frame above the bag clamp 11 and operable to deposit a batch of packs 14 (FIG. 3) of produce or articles into the open mouth of a bag supported by the bag clamp 11, an upper conveyor 15 mounted on the top of the frame and arranged to feed the individual packs 14 in succession to the batch feed device 13, a lower conveyor 16 mounted on the base of the frame and arranged to receive a filled bag released from the bag clamp, the lower conveyor 16 being aligned with the upper conveyor 15 and operable to move a filled bag into a position below a bag-sealing device 17 mounted on the frame, a carriage 18 mounted on the frame at one side of the lower conveyor 16 for movement along the conveyor, two similar constrictor units 19, 20 below the bag clamp 11, the constrictor unit 19 being mounted on the side of the frame opposite that fitted with the carriage 18, and the constrictor unit 20 being mounted on the carriage and arranged so that the two constictor units are in spaced apart opposing relation when the carriage is in its rear position directly below the bag clamp, and the constrictor unit 20 is wholly offset from the constrictor unit 19 when the carriage is in its forward position below the bag sealing device 17, and a suction head 21 mounted on the constrictor unit 20 at the upper end thereof and operable to support a filled bag on the lower conveyor 16 during movement of the bag and the constrictor unit 20 along the conveyor.

The main frame 10 comprises a base consisting of two side members 22 interconnected by transverse members 23, upright members 24 mounted on one side of the base and supporting the constrictor unit 19, the bag clamp 11, the batch feeder device 13 and the upper conveyor 15, and a side frame mounted on the other side of the base and consisting of two upright members 25, and a horizontal member 26 of inverted channel shaped cross section mounted on the upright members 25. The member 26 serves as an upper guide rail for the carriage. A lower guide rail 28 for the carriage is mounted on the transverse members 23 of the base.

The bag clamp 11 (FIG. 2) comprises an annular collar 29 bolted to one of the upright members 24 of the frame, the collar extending across the width of the frame, two outer jaws 30 secured to the collar on opposite sides of the frame respectively, two inner jaws 31 pivotally mounted on the collar 29 between the two outer jaws and arranged to co-operate therewith to clamp the wall of a bag at opposite sides of the mouth therof, and a pneumatic piston and cylinder unit 33 operable to move the inner jaw into and out of clamping engagement with the outer jaws respectively. Each outer jaw 30 comprises a substantially upright plate 34, the upper edge of which is secured to the collar 29 and the lower edge portion of which is fitted with a rubber gripper pad 35 on the surface thereof facing inwards towards the associated inner jaw 31. Each of the inner jaws 31 comprises a plate 36 having a size and shape similar to that of the plate 34 of the associated outer jaw 30, and the upper edge of the plate 36 is welded to a rod 37 rotatably mounted in bearings on the collar 29. The outer surface of the lower edge portion of the plate 36 is fitted with a rubber gripper pad 39 arranged to engage flat against the gripper pad 35 on the associated outer jaw when the inner jaws are swung outwards. The piston and cylinder unit 33 has the cylinder thereof pivotally connected to one of the inner jaws and the piston rod thereof pivotally connected to the other of the inner jaws.

Tha batch feed device 13 comprises two similar rectangular batch plates 45 arranged one on each side of the frame, each of the plates 45 being welded to a rod 46 extending along a side edge of the plate 45. The ends of each rod 46 are pivotally mounted in bearings on the frame, the two rods being arranged in a horizontal position parallel to one another and directly above the pivot rods 37 of the inner jaws of the bag. Each of the rods 46 is fitted with a crank 48, the two cranks being interconnected by a bar 49 arranged to couple the two cranks together for simultaneous pivotal movement in opposite directions, and a piston and cylinder unit 50 has the cylinder thereof pivotally mounted on the frame and the piston rod thereof pivotally connected to one of the cranks 48. Upon operation of the piston and cylinder unit 50, the plates 45 are movable about the axes of the rods 46 between a horizontal position in which the plates lie in the same horizontal plane with the adjacent edges spaced close together, and a vertical dependent position in which the plates are aligned with the inner jaws of the bag clamp when the inner jaws are in clamping engagement with the outer jaws.

The upper conveyor 15 comprises a sub-frame including two parallel side beams, a plurality of rollers rotatably mounted in bearings on the side beams, and an endless belt 57 extending around the rollers. The roller at the downstream end of the conveyor is driven by a variable speed electric motor (not shown). The side beams are fitted with side plates 59 which project above the endless belt 57 and which also extend beyond the downstream end of the belt. The downstream end of the belt terminates immediately to the front of the batch plates 45 of the batch feed device 13, and the forwardly extending end portions of the side plates 59 co-operate with the plates 45 of the batch feed device, when in the closed horizontal position, to form a trough 60 for reception of packs 14 discharged from the conveyor 15. One of the side plates 59 is fitted with the photocell 61 of a counter for counting the number of packs 14 fed to the batch feed device 13. An elevator conveyor (not shown) of standard construction is arranged to supply packs to the upper conveyor 15.

The lower conveyor 16 is mounted on the base of the frame and comprises an endless belt 65 extending around end rollers. The downstream end roller is driven by an electric motor (not shown). The upstream end of the belt is positioned below the bag clamp 11 for reception of a filled bag released from the bag clamp.

The carriage 18 comprises a framework having two upright members 68 fitted at the lower ends thereof with grooved wheels 69 mounted on the lower guide rail 28. The upright members 68 are also fitted with wheels 70 arranged to roll along the inside surface of the adjacent side wall of the member 26 of inverted channel shaped cross sections which serves as the upper guide rail. A further wheel 71 on the carriage framework is arranged to roll along the outside surface of the adjacent side wall of the upper guide rail 26. The carriage framework also includes a horizontal member 72 which projects rearwards at a level above the top surface of the upper guide rail 26. The carriage is movable along the rails 26, 28 by a pneumatic piston and cylinder unit 73 having the cylinder thereof mounted on the rail 26 and the piston rod thereof connected to a lug 74 on the rear end of the member 72.

Each constrictor unit 19, 20 comprises an upright casing 75 open at one side thereof and fitted with three lowering plates, namely a top lowering plate 76, a middle lowering plate 77 and a bottom lowering plate 78, the three lowering plates being positioned one above the other at the open side of the casing and each lowering plate being movable between a horizontal position and a vertical dependent position. The top lowering plate 76 is welded to a rod **76*a* extending along a side edge of the plate 76, the ends of the rod being pivotally mounted in bearings on the end walls 79 of the casing, and the top lowering plate is movable between its horizontal and vertical dependent positions by a pneumatic piston and cylinder unit 76*c* having the cylinder thereof pivotally connected to one of the end walls 79 of the casing 75 and the piston rod thereof pivotally connected to a crank 76*d* on the rod 76*a*. Similarly, the middle lowering plate 77 is welded to a rod 77*a* pivotally mounted in bearings on the end walls 79 of the casing and movable between its horizontal and vertical dependent positions by a piston and cylinder unit 77*c* connected to a crank 77*d* on the rod 77*a*, and the bottom lowering plate 78 is welded to a rod 78*a* pivotally mounted in bearings on the end walls 79 of the casing and movable between its horizontal and vertical dependent positions by a piston and cylinder unit 78*c* connected to a crank 78*d* on the rod 78*a***.

Figure 3:
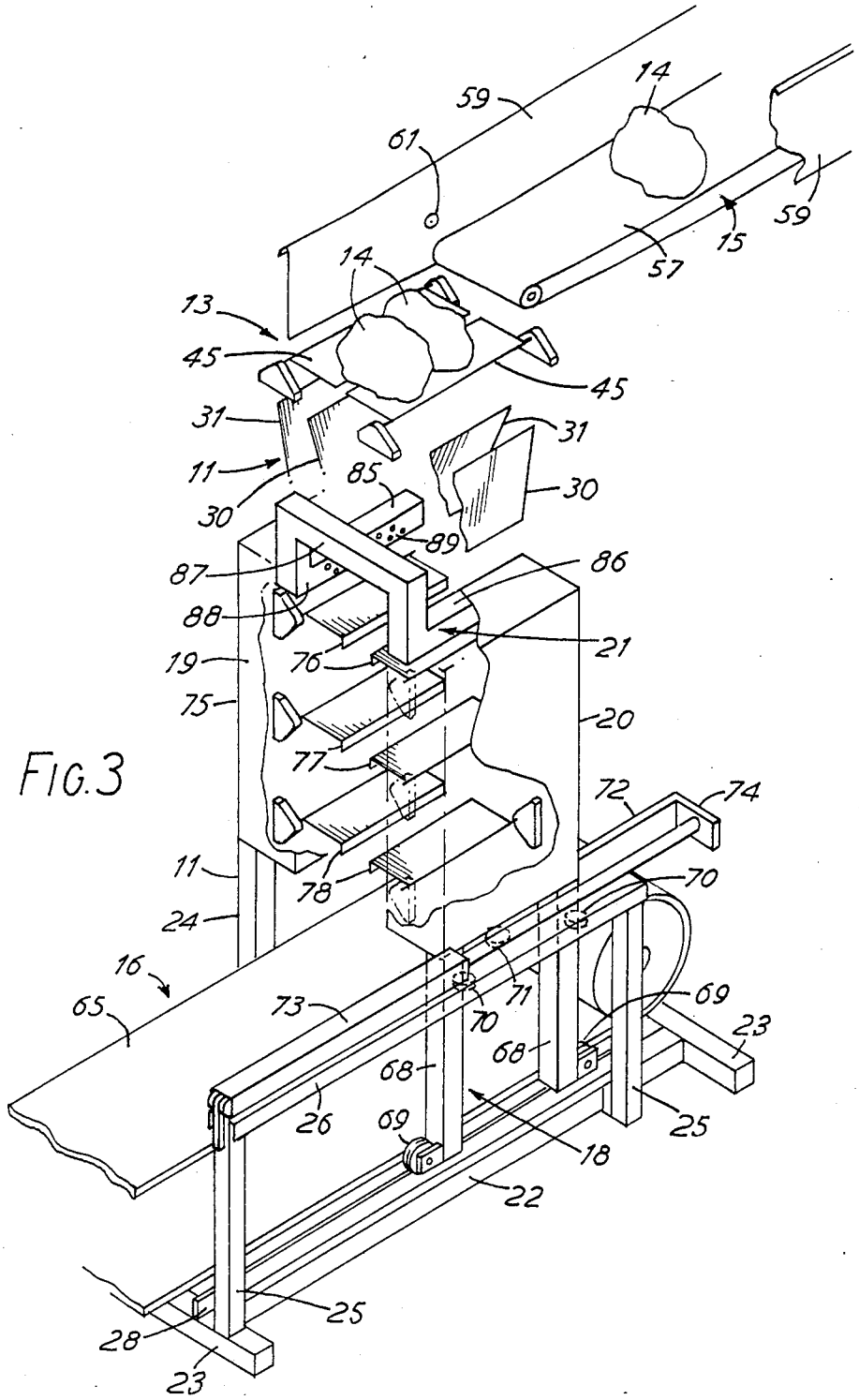
FIG. 3 is a cut-away perspective view of part of the machine showing the carriage and movable constrictor unit in the rear position.
Figure 4:
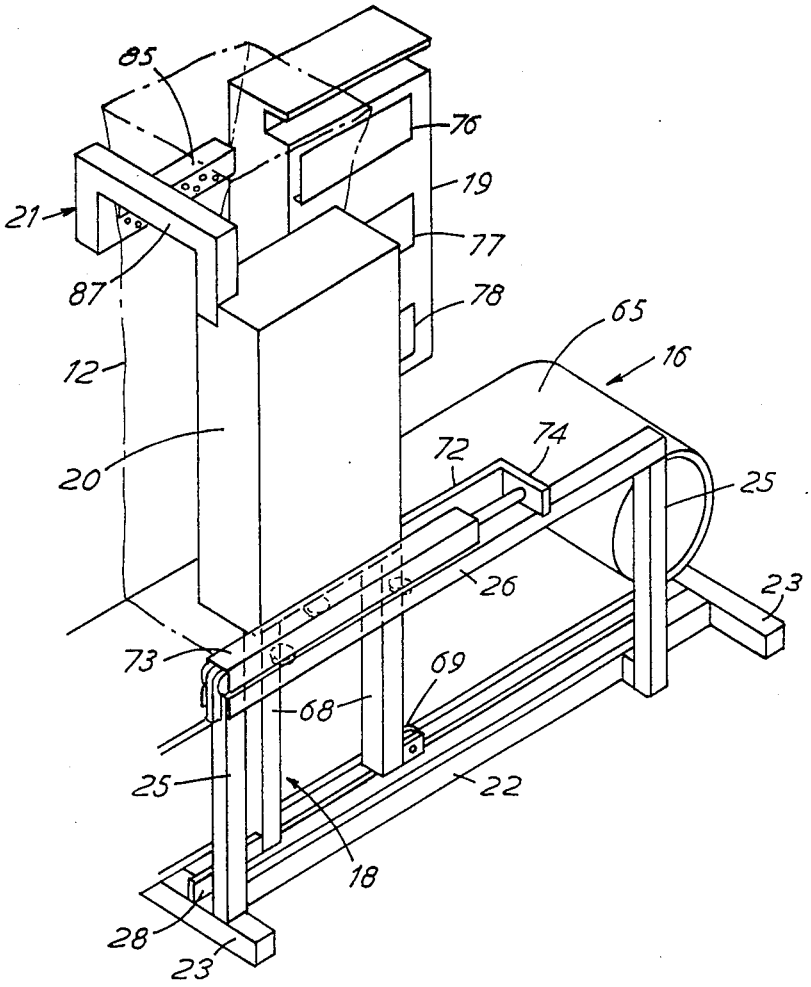
FIG. 4 is a view similar to FIG. 3 showing the carriage and movable constrictor unit in the forward position.

The constrictor unit 19 is mounted on the upright members 24 of the main frame 11 and directly below the bag clamp 11, and the constrictor unit 20 is mounted on the upright members 68 of the carriage 18, the two constrictor units being arranged so that, when the carriage is in its rearward position at the upstream end of the lower conveyor 16 (as shown in FIG. 3) with the lowering plates in the horizontal position, the top lowering plates 76 on the two constrictor units lie in the same horizontal plane, the middle lowering plates 78 lie in the same horizontal plane, and the bottom lowering plates 79 also lie in the same horizontal plane. The two constrictor units are spaced apart a distance sufficient to accommodate therebetween a bag 12 filled with the packs 14, when the lowering plates are in the vertical dependent position. The free ends of the lowering plates 76, and also the free ends of the lowering plates 77 and 78, when in the horizontal position, are spaced apart a distance substantially less than that of the minimum dimension of the lowering plates are turned downward as to provide a flat side surface for engagement with a bag in the bag clamp.

The suction head 21 comprises a closed duct consisting of two straight tubes 85, 86 of rectangular section arranged horizontal and parallel to one another with their side walls vertical and spaced apart a distance equal to the distance between the two constrictor units 19, 20, and an inverted U-shaped bridge tube 87 connected to the front ends of the tubes 85, 86. The side wall 88 of the tube 85 which faces the other tube 86 is formed along its centre portion with apertures 89, and similarly the side wall 90 of the tube 86 which faces the other tube 85 is formed along its centre portion with apertures (not shown). The tube 86 of the suction head is securely fixed in recesses in the two end walls 79 of the casing of the constrictor unit 20 with the external surface of the apertured side wall 90 flush with the inner facing surface of the casing, and the other tube 85 of the suction head is a sliding fit in recesses in the two end walls 79 of the casing of the constrictor unit 19 with the external surface of the apertured side wall 88 flush with the inner facing surface of the casing. The interior of the tubes 85, 86, 87 is connected to a source of vacuum (not shown).

The machine is fitted with a controller 95 for operating the components in sequence, as hereinafter described. Each cycle of operations is initiated by a foot switch (not shown).

At the start of a cycle of operation of the machine, the batch feed device 13 is closed with the hinged batch plates 45 horizontal, the bag clamp 11 is open with the inner jaws 31 spaced inwardly from the outer jaws 30, the pairs of lowering plates 76, 77, 78 are in their vertical dependent positions, and the carriage 18 is in its forwards position so that the movable constrictor unit 20 is in its inoperative position in which it is offset to the front of the fixed constrictor unit. Vacuum is applied continuously to the tubes 85, 86, 87 of the suction head. An empty bag is then fed to the bag clamp. This can conveniently be done by an automatic bag feeder device since, with the movable constrictor unit 20 in its forward position, the bag clamp is readily accessible from the side of the machine opposite the fixed constrictor unit.

When the cycle is initiated by actuation of the foot switch, the controller operates the bag clamp to clamp the bag in position, operates the piston and cylinder unit 73 to drive the carriage into its rear position with the constrictor unit 20 in opposing relation to the constrictor unit 19, and operates the piston and cylinder units **76*c*, 77*c*, 78*c* to move the pairs of lowering plates into their horizontal positions. Each pair of the lowering plates then press the sides of the bag inwards to form a constriction in the interior of the bag. Packs 14 of produce or articles are then fed in succession on to the upper conveyor 15 and the conveyor driven by its electric motor. The number of packs passing the photoelectric cell 61 on the upper conveyor is counted by the controller. The upper conveyor delivers the packs 14 onto the platform formed by the horizontal batch plates 45 in the trough 60, and when a selected number of the packs are supported on the batch plates, the controller operates the piston and cylinder unit 50 to swing the batch plates 45 into the vertical dependent position so that the batch of packs drops through the bag clamp 11 and into the bag. The packs drop down onto the walls of the bag overlying the upper lowering plates 76. The controller then returns the batch plates 45 to the horizontal position to receive the next batch. When a sufficient number of packs have been fed into the bag to fill substantially the portion of the bag above the top lowering plates 76, the controller operates the piston and cylinder units 76c to swing the top lowering plates 7 into the dependent position so that the packs drop downwards onto the walls of the bag overlying the middle lowering plates 77. Then, when a sufficient number of packs have been fed into the bag to fill substantially the portion of the bag above the middle lowering plates, the controller swings the middle lowering plates into the dependent position so that the packs supported thereon drop onto the walls of the bag overlying the bottom lowering plates. When the portion of the bag above the bottom lowering plates has been filled with packs, the controller swings the bottom lowering plates into the dependent position so that when the desired number of packs for the bag have been fed into the bag, the controller releases the bag clamp so that the filled bag drops onto the lower conveyor 16**.

When the packs are fed initially into the bag and onto the wall of the bag overlying the top lowering plates, the packs force the walls of the bag outwards into engagement with the tubes 85, 86 of the suction head, and the vacuum in these tubes, acting through the apertures in the tube walls, holds the wall of the bag against the tubes 85, 86. When the filled bag is released from the bag clamp, the walls of the bag slide down the surfaces of the tubes 88, 90 but remain held thereto by the suction.

The controller then drives the lower conveyor 16 and the carriage 18 in the forwards direction at the same speed to feed the filled bag to the bag sealing device 17 at the front end of the conveyor. The suction head supports the filled bag during its movement away from the fixed constrictor unit 19, and accurately presents the walls of the bag to the bag sealing device 17. Use of the suction head is particularly advantageous when the bag is made of thin plastic material of, for example, two thousandths of an inch thickness.

The controller is of course programmed to operate the lowering plates and release the bag clamp in accordance with the number of packs fed past the photoelectric cell. The controller may be of any suitable construction known in the art and adapted to perform the required functions in the desired sequence. The controller is suitable for filling bags with a wide range of products, and the controller may be adjusted as desired to vary the number of packs in each batch and the numbers of batches supported on each set of lowering plates before the lowering plates are opened.

The components of the machine described above may of course be replaced by equivilant components having substantially the same function. For example the hinged batch plates can be replaced by a sliding gate to permit the handling of a wide range of products and bag weights.

We claim:

1. A machine for filling a bag or sack with individual packs of produce or articles, comprising a main frame fitted with a bag clamp for supporting a bag in an upright position with the mouth thereof open at the top of the bag, a conveyor operable to feed the packs into a bag held in the bag clamp, a plurality of constriction means mounted on the frame below the bag clamp and each operable to at least partially flatten a bag held in the bag clamp to form a plurality of constrictions of the interior of the bag at spaced intervals along the length of the bag whereby packs fed into the bag are supported initially on the walls of the bag at the uppermost constriction, and control means for releasing each of the constriction means in sequence by releasing in turn the constriction means which is uppermost to permit the packs to drop in several stages into the lower portion of the bag, wherein said constriction means are housed in two opposing constrictor units arranged below the bag clamp, one of the constrictor units being fixed and the other constrictor unit being movable between an operating position in which it is in opposing relationship to the fixed constrictor unit so that a bag on the bag clamp is suspended between the constrictor units and an offset position in which the movable constrictor unit is displaced to one side of the fixed constrictor unit.

2. A machine as claimed in claim 1 and including a conveyor for receiving filled bags released from the bag clamp, and a carriage movable along guide rails extending parallel to the conveyor, the movable constrictor unit being mounted on the carriage.

3. A machine as claimed in claim 2, wherein the movable constrictor unit is fitted with a suction head comprising a hollow duct adapted to be connected to a source of vacuum, said duct having surfaces arranged to engage the wall of a bag suspended from the bag clamp, and said surfaces being formed with apertures, whereby the vacuum in the duct holds the wall of the bag against the apertured surfaces.

4. A machine as claimed in claim 3 wherein said hollow duct comprises two tubes interconnected by a bridge tube, and each of the constrictor units comprises a casing having a slot adjacent the upper end thereof, one of said tubes being fixed in the slot in one of the constrictor units and the other of said tubes being slidably mounted in the slot in the other of the constrictor units.

5. A machine as claimed in claim 1, wherein each of said constrictor units comprises a casing, lowering plates pivotably mounted in the casing, and power driven means operable to pivot each of the lowering plates between a horizontal position and a vertical dependent position, each lowering plate on one of the constrictor units co-operating with a corresponding lowering plate on the other constrictor unit, when the lowering plates are in the horizontal position, to at least partially flatten part of a bag on the bag clamp and form a constriction of the interior of the bag.

* * * * *